US007243395B2

(12) United States Patent
Haymond

(10) Patent No.: US 7,243,395 B2
(45) Date of Patent: Jul. 17, 2007

(54) BUMPER DEVICE

(75) Inventor: Bradley J. Haymond, Aurora, IL (US)

(73) Assignee: Illinois Tool Works Inc, Glenview, IL (US)

( * ) Notice: Subject to any disclaimer, the term of this patent is extended or adjusted under 35 U.S.C. 154(b) by 50 days.

(21) Appl. No.: 10/606,875

(22) Filed: Jun. 26, 2003

(65) Prior Publication Data

US 2004/0140628 A1 Jul. 22, 2004

Related U.S. Application Data

(60) Provisional application No. 60/441,517, filed on Jan. 21, 2003.

(51) Int. Cl.
*B05D 15/06* (2006.01)
*E05F 5/06* (2006.01)

(52) U.S. Cl. ..... 16/86 R; 16/86 B

(58) Field of Classification Search ..... 16/86 R, 16/86 A, 86 B; 296/35.1; 293/142; 49/460; 292/DIG. 15, DIG. 56, DIG. 19
See application file for complete search history.

(56) References Cited

U.S. PATENT DOCUMENTS

| | | | | | |
|---|---|---|---|---|---|
| 2,068,928 | A | * | 1/1937 | Paolillo | 16/86 A |
| 2,899,703 | A | * | 8/1959 | Johnson | 16/86 A |
| 3,050,770 | A | * | 8/1962 | Morse et al. | 16/86 A |
| 3,362,040 | A | * | 1/1968 | Gurzenda | 16/86 R |
| 3,368,806 | A | * | 2/1968 | Szonn | 267/153 |
| 3,386,125 | A | * | 6/1968 | Hand | 16/86 R |
| 3,864,785 | A | * | 2/1975 | Hoppock | 16/86 A |
| 3,969,786 | A | * | 7/1976 | Peak | 16/86 A |
| 3,994,043 | A | * | 11/1976 | Gurzenda | 16/86 A |
| 4,532,672 | A | | 8/1985 | Anderson | |
| D288,525 | S | * | 3/1987 | Angle | D8/400 |
| D324,170 | S | * | 2/1992 | Owens et al. | D8/402 |
| D329,590 | S | * | 9/1992 | Chapman | D8/402 |
| 5,303,526 | A | * | 4/1994 | Niese | 52/393 |
| 5,603,141 | A | * | 2/1997 | Gledhill | 16/86 A |
| D412,106 | S | * | 7/1999 | Kennard, IV | D8/402 |
| 6,209,170 | B1 | | 4/2001 | Huynh | |
| 6,295,697 | B1 | * | 10/2001 | Simon | 16/86 R |
| 6,430,775 | B1 | * | 8/2002 | Bushey | 16/86 A |

FOREIGN PATENT DOCUMENTS

| | | |
|---|---|---|
| JP | 2000002281 | 7/2000 |
| JP | 2001311357 | 9/2001 |

* cited by examiner

*Primary Examiner*—Thomas B. Will
*Assistant Examiner*—Mark Williams
(74) *Attorney, Agent, or Firm*—Mark W. Croll; Paul F. Donovan

(57) ABSTRACT

A bumper device for use in muffling or deadening the sound created by a door closing against a cabinet includes a bumper device body defining a base, a ring-shaped portion, and a concentrically positioned, conical shaped center portion that further defines an indentation at a top end. A channel is formed between the ring-shaped portion and the conical center portion. In use, the indentation at the top end of the conical shaped center portion and the channel serve to trap the sound created by the door closing against the cabinet, thereby reducing if not eliminating the undesirable noise created by the door closing against the cabinet. The shape and configuration of the ring-shaped and center portions prevent the door from contacting the cabinet even when the door is closed with a considerable amount of force.

10 Claims, 3 Drawing Sheets

BUMPER DEVICE

CROSS REFERENCE TO RELATED APPLICATION

This Non-Provisional Application claims benefit to U.S. Provisional Application Ser. No. 60/441,517 filed Jan. 21, 2003.

FIELD OF THE INVENTION

The present invention relates generally to bumper devices for cabinet or vanity doors and more particularly to bumper devices that muffle the sound that cabinet or vanity doors make when they are closed.

BACKGROUND OF THE INVENTION

It is known to use bumper devices for various applications, including use on a cabinet or vanity door to buffer the door against the cabinet or vanity as the door is closed. It is known that without such a device, the cabinet or vanity door, as it is closed, will contact the cabinet or vanity and, depending on the force and speed at which the door is closed, will create an undesirable loud sound. There are several known examples of bumper devices for use with cabinets or vanities. These examples include pieces of foam or molded pieces of a urethane material. Drawbacks exist with respect to the known bumper devices. As an example, while the known bumper devices serve to buffer the door as the door is closed against the cabinet or vanity, these bumper devices do not adequately muffle the sound created by the door closing against the cabinet or vanity. This inability to adequately muffle the sound is a result of the known bumper devices not having the ability to trap a sizable amount of the sound created by the door closing against the cabinet or vanity. Another known drawback with existing bumper devices is that these bumper devices typically do not include a sturdy base feature to prevent the door from contacting the cabinet. In other words, typical bumper devices are made of a soft compressible material that will compress as the door is closed against the cabinet or vanity. Often, the material will compress to the point that the door comes in contact with the cabinet or vanity, thereby creating an undesirable loud sound.

The present invention is directed at overcoming these and other known problems and shortcomings with existing bumper devices.

SUMMARY OF THE INVENTION

The present invention is directed to a bumper device that muffles or deadens the sound that a door, such as a cabinet and vanity door, makes when it is closed. To accomplish this sound muffling or deadening, the bumper device is made of a compressible material that is designed to include an indentation at its top and a channel around its base. The indentation and the channel serve to trap and absorb a significant amount of sound created by the door closing against the cabinet or other structure. In addition, the bumper device of the present invention includes a sturdy base that prevents the door from contacting the cabinet even when the door is closed with a considerable amount of force. Also, the features of the bumper device of the invention allow the bumper device to outperform and outlast known bumper devices.

Other features and advantages of the invention will become apparent to those skilled in the art upon review of the following detailed description, claims and drawings in which like numerals are used to designate like features.

Figure 1:
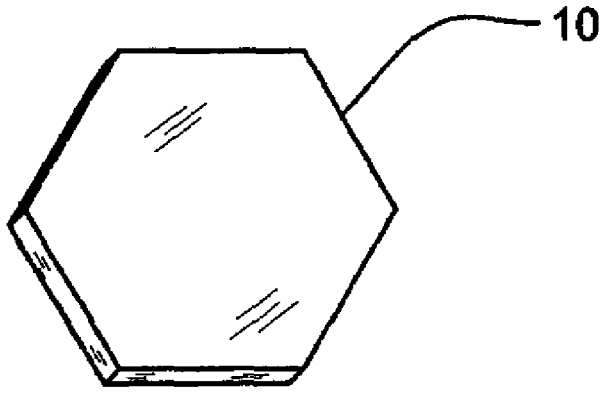
FIG. 1 (Prior Art)
FIG. 1 shows a top isometric view of a prior art bumper device.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Figure 2:
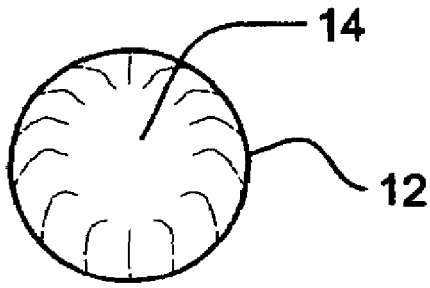
FIG. 2 (Prior Art)
FIG. 2 shows a top isometric view of another prior art bumper device.

Referring to FIGS. 1 and 2, there are depicted prior art bumpers 10 and 12 that are conventional buffering devices for use with a cabinet or vanity door to buffer the door as it is closed against the cabinet or vanity. The prior art bumper 10 is shown as a planar piece of soft foam having a predetermined thickness that is attached adhesively to either a door or cabinet. In use, the prior art bumper 10 is positioned between the door and cabinet to buffer the door against the cabinet when door is in a closed position. Because the prior art bumper 10 is soft foam it will compress significantly when the door closes against the cabinet and, depending on the amount of force applied to closing the door, the bumper 10 will not prevent the door from the contacting the cabinet. Moreover, this prior design allows for an excess amount of surface area to come into contact with the cabinet frame, thereby allowing an undesirable slapping sound when the door closes. Referring to FIG. 2, the prior art bumper 12 is a semi-spherical shaped bumper made typically of a urethane material. Some known bumpers 12 further include a flat or slightly concave shaped top portion 14. The bumper 12 is significantly more rigid than bumper 10 and will therefore usually prevent the door from contacting the cabinet. However, because of its rigidity and design, the bumper 12 does not muffle a significant amount of sound created by the door closing against the cabinet.

Figure 3:
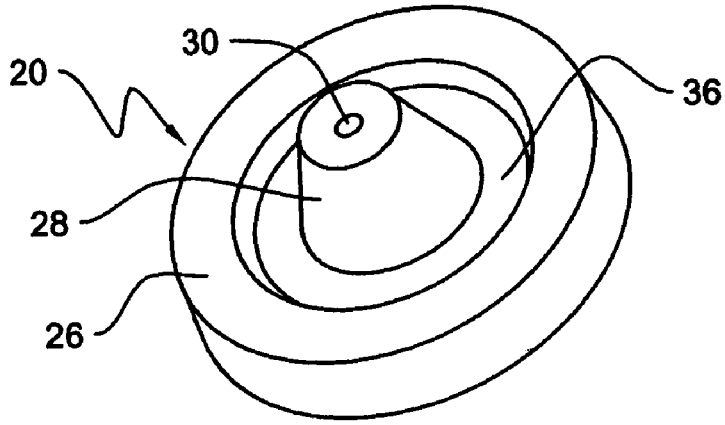
FIG. 3 shows an isometric view of the bumper device of the present invention.

Referring to FIG. 3, there is depicted an exemplary embodiment of a bumper device 20 of the present invention. The bumper device 20 significantly reduces the noise caused by, for example, a door, such as a cabinet or vanity door closing against a surface, such as a cabinet or vanity. The bumper device 20 also provides a sturdy buffer that prevents the door from contacting the cabinet or vanity. The bumper device 20 may be used in various applications including, without limitation, kitchen and bathroom cabinet doors and drawers, bathroom vanities, or in any other application where it is desirable to reduce the noise produced by a structure coming into contact with another structure. The term "structure" as used herein includes, without limitation, doors, walls, floors, ceilings, furniture, counters, automobiles, appliances, and similar other objects. Because of the numerous applications and varying uses of the bumper device 20, the present invention is not and should not be considered limited to the applications and uses described herein.

Figure 4:
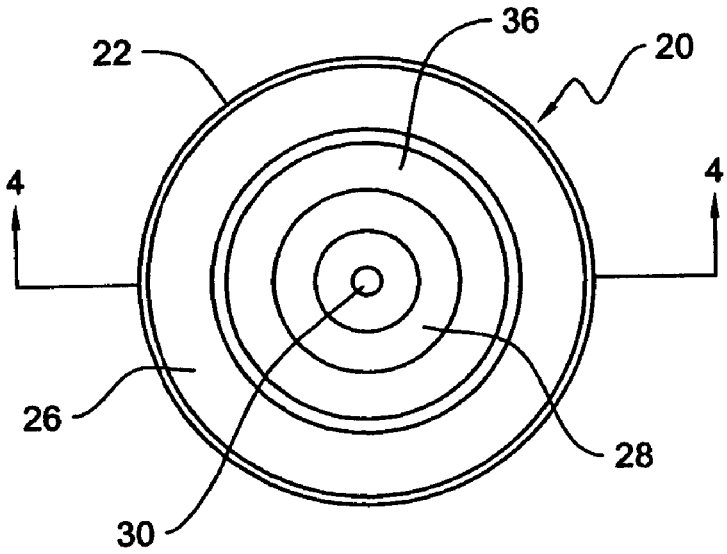
FIG. 4 shows a top plan view of the bumper device of FIG. 3.
Figure 5:
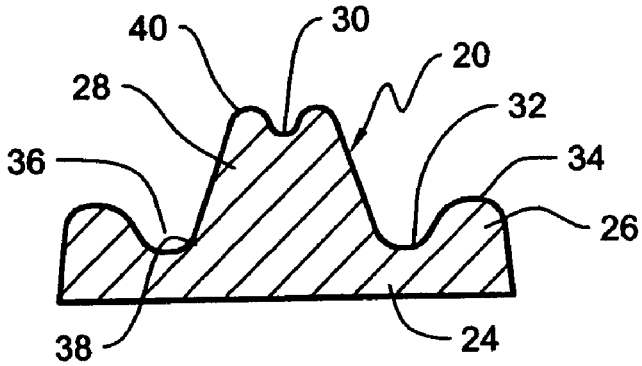
FIG. 5 shows a cross-sectional view taken at line 4-4 of the bumper device of FIG. 4.

Referring to FIGS. 3-5, the bumper device 20 includes a bumper body 22 defining a base 24, a ring-shaped portion 26 positioned at the periphery of the base 24 and extending upwardly from the base 24, and a concentrically positioned, conical-shaped central portion 28 also extending upwardly from the base 24. Located that the uppermost portion of the conical-shaped central portion 28 is an indentation 30 that, in use, assists in noise dampening by trapping a significant amount of sound within the indentation 30, as described in more detail below. In an exemplary embodiment, the bumper device 20 of the present invention is made from a soft elastic material, such as urethane. It should be understood that the invention is not limited to the use of a urethane material and that other suitable materials, such as plastics, polymers or other similar materials, may be used with the invention.

Referring to FIG. 5, the ring-shaped portion 26 of the bumper body 22 is formed integral with the base 24 and includes a proximal end 32 and a distal end 34. As shown, ring-shaped portion 26 tapers such that the proximal end 32 has a thickness that is greater than the thickness of the distal end 34. This greater thickness at the proximal end of the ring-shaped portion 26 provides the bumper device 20 with a rigid support foundation that, in use, prevents the urethane material of the bumper device 20 from compressing significantly, thereby preventing the door from contacting the cabinet, as described below. The distal end 34 of the ring-shaped portion 26 may include a flat planar surface or, alternatively, a rounded surface. One of skill in the art will understand that variations to the size, shape, configuration, and orientation of the ring-shaped portion 26 are possible and are considered within the scope of the invention.

Referring to FIGS. 3 and 5, located between the ring-shaped portion 26 and the conical-shaped center portion 28 is a channel 36. In use, and as described below, the channel 36 serves as a second sound trapping and absorbing region similar to the indentation 30. The channel 36 will trap and absorb most if not all of the remaining sound created by the door closing against the cabinet that was not trapped or absorbed by the indentation 30.

Returning to FIG. 5, the conical-shaped center portion 28 is formed integral with the base 24 and extends outwardly from the center of the base 24. The center portion 28 is shown positioned at or near the center of the bumper device. However, one of skill in the art will understand that the center portion 28 may be located off-center or away from the center and still provide the desired sound dampening. The center portion 28 includes a proximal end 38 and a distal end 40. Similar to the ring-shaped portion 26, the center portion 28 tapers such that the proximal end 38 has a thickness that is greater than the thickness at the distal end 40. Again, the greater thickness at the proximal end provides the bumper device 20 with a rigidity that, in use, prevents the urethane material of the bumper device 20 from compressing significantly. The distal end 40 of the center portion 28 may include a flat planar surface or, alternatively, a rounded surface. As stated, an indentation 30 is located at the distal end 40 of the center portion 28 to assist in sound dampening. One of skill in the art will also understand that variations to the size, shape, configuration, location and orientation of the center portion 28 are possible and are considered within the scope of the invention.

Figure 6:
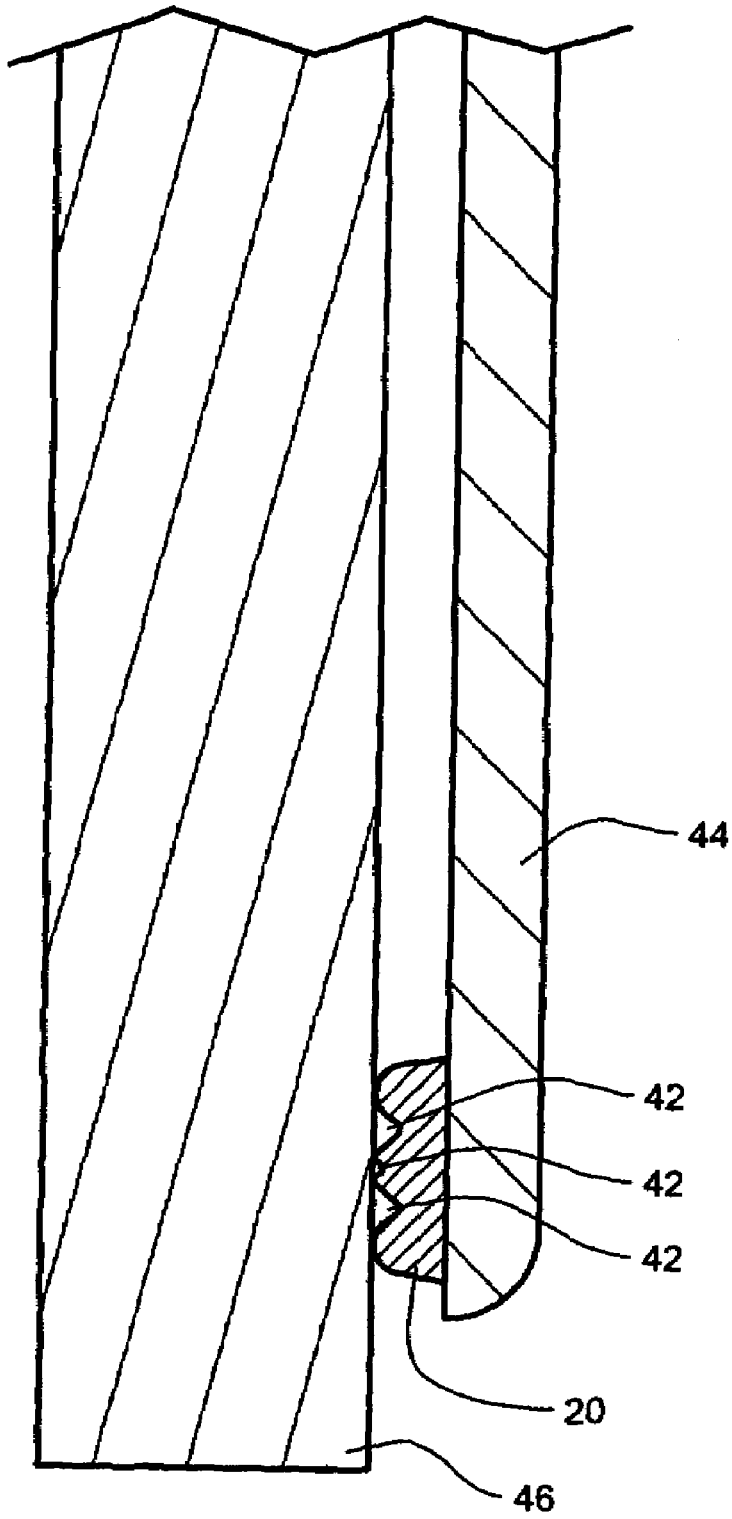
FIG. 6 shows an exemplary installation of the bumper device of FIG. 3.

Referring to FIG. 6, there is depicted an exemplary installation of the bumper device 20 onto a door 44. The bumper device 20 is attached or secured to the door 44 through the use of an adhesive, bonding material, or fastener, or through the use of any other known method of securing a bumper to a door. As shown in FIG. 6, after the door 44 is closed against a cabinet 46 or other structure, the bumper device 20 will be in a compressed position. In a compressed position, the bumper device 20 will form trapped sound areas 42 to trap and absorb most of the sound created by the door 44 closing against the cabinet 46. The trapped areas are defined by the indentation 30, the channel 36, and the surface of the cabinet 46.

In operation, as the door 44 is closed against the cabinet 46, the indentation 30 of the center portion 28 receives and traps an initial amount of sound. The sound is trapped between the indentation 30 and the cabinet 46. As the door 44 continues to close against the cabinet 46, the center portion 28 will compress until the ring-shaped portion 26 contacts the cabinet 46. At this point, much of the remaining sound produced by the closing of the door 44 against the cabinet 46 is received by and becomes trapped and absorbed in the channel 36. The sound is trapped between the channel 36 and the cabinet 46. As stated above, the ring-shaped portion 26 also will prevent the door 44 from contacting the cabinet 46, even when a considerable amount of force is applied to the door as it is closed. After the door is closed, the center portion 28 may return to its uncompressed state and the ring-shaped portion 26 may cease contacting the cabinet 46.

Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A bumper device for reducing the noise created by a door closing against a cabinet the bumper device comprising:

a bumper body including a solid base, a ring-shaped portion and a concentrically positioned center portion extending upwardly from the base, the center portion defining a top end extending above a top portion of the ring-shaped portion, the top end including an indentation extending a short distance into the center portion such that a bottom of the indentation is located above the top portion of the ring-shaped portion in an uncompressed state, and such that the bottom of the indentation is located in a plane below the top portion of the ring shaped portion in a fully compressed state, the indentation defining a trapped sound area when the bumper device is subjected to the compressed state, the center portion having a continuous, solid cross-section, said bumper body being made of a soft elastic material, wherein the ring-shaped portion defines a first end and a second end, the ring-shaped portion extending outwardly from the base in such a manner that the ring-shaped portion tapers in cross-sectional thickness between the first end and the second end.

2. The bumper device as set forth in claim 1, wherein the base defines a periphery and wherein the ring-shaped portion is positioned at the periphery of the base.

3. The bumper device as set forth in claim 2, wherein the ring-shaped portion is formed integral with the base.

4. The bumper device as set forth in claim 3, wherein the center portion defines a conical shape and wherein the center portion is formed integral with the base.

5. The bumper device as set forth in claim 1, wherein the bumper body is made of a urethane material.

6. The bumper device as set forth in claim 1, wherein the bumper body defines a channel formed between the center portion and the ring-shaped portion.

7. A device for reducing the noise created by a first structure contacting a second structure, the device comprising:

an elastomeric body having a continuous, solid cross section, the elastomeric body defining a base, a channel, and a first portion extending outwardly from the base, the first portion further defining an indentation, the base defining a periphery, the elastomeric body further defining a second portion extending from the base and positioned adjacent to the periphery of the base, the second portion being ring-shaped, the channel being located between the first portion and the second portion, the first portion defining a conical shape and including a first end formed integral with the base and a second end that further includes the indentation, the elastomeric body being made of a urethane material, the second portion defining a first end and a second end, the second portion extending outwardly from the base in such a manner that the second portion tapers in cross-sectional thickness between the first end and the second end, the device being configured in such a manner that in an uncompressed state, a bottom of the indentation is located above an uppermost portion of the ring-shaped portion, and in a compressed state, the bottom of the indentation is located below the uppermost portion of the ring-shaped portion, such that in the compressed state, trapped sound areas are defined by the indention, the channel and the mating structure.

8. A system for reducing the sound created by a first structure contacting a second structure, the system comprising:

a compressible sound reducing body defining a conically shaped center portion having a proximal end, a distal end, and an indentation positioned at the distal end, said center portion having a continuous, solid cross-section extending therethrough, a ring-shaped support portion spaced apart from and extending around the center portion, and a channel fanned between the center portion and the support portion, wherein the indentation includes a bottom that is positioned above the ring-shaped portion in an uncompressed state, the compressible sound reducing body being configured in such a manner that in a fully compressed state, the bottom of the indentation is positioned below an uppermost portion of the ring-shaped portion, the indentation defining a trapped sound area when the compressible sound reducing body is subjected to the compressed state.

9. The system as set forth in claim 8, wherein the support portion defines a proximal end having a thickness and a distal end having a thickness, and wherein the support portion tapers in cross-sectional thickness between the proximal end and the distal end.

10. The system as set forth in claim 8, wherein the compressible sound reducing body is made of a urethane material.

* * * * *